United States Patent [19]

Bogut et al.

[11] Patent Number: 5,006,676

[45] Date of Patent: Apr. 9, 1991

[54] MOVEMENT SENSOR SWITCH

[75] Inventors: Henry A. Bogut, Coral Springs; Anthony Dolezal, Pompano Beach; Jose M. Fernandez, Plantation, all of Fla.

[73] Assignee: Motorola Inc., Schaumburg, Ill.

[21] Appl. No.: 457,138

[22] Filed: Dec. 26, 1989

[51] Int. Cl.[5] ..... H01H 35/14

[52] U.S. Cl. ..... 200/61.52; 200/DIG. 29

[58] Field of Search ..... 200/61.45 R, 61.45 M, 200/61.48, 61.49, 61.51, 61.52, 61.53, DIG. 29, 52 R, 61.83, 277.1, 511

[56] References Cited

U.S. PATENT DOCUMENTS

| | | | |
|---|---|---|---|
| 1,662,979 | 3/1928 | Nelson | 200/61.52 |
| 1,915,267 | 6/1933 | Bigelow | 200/DIG. 29 X |
| 2,950,365 | 8/1960 | Bolstad | 200/61.52 |
| 3,564,496 | 2/1971 | Brooks et al. | 200/61.52 X |
| 3,836,739 | 9/1974 | Endo | 200/61.52 X |
| 3,889,774 | 6/1975 | Schwenk | 200/DIG. 29 X |
| 4,884,067 | 11/1989 | Nordholm et al. | 340/686 |

FOREIGN PATENT DOCUMENTS

| | | | |
|---|---|---|---|
| 125493 | 11/1984 | European Pat. Off. | 200/61.45 M |

*Primary Examiner*—J. R. Scott
*Attorney, Agent, or Firm*—Pablo Meles

[57] ABSTRACT

Briefly, according to the invention, a tilt switch 30 comprises a body 20 including a substantially conical cavity. The substantially conical cavity has at least a portion 24 which is electrically conductive. The tilt switch further has an electrical contact 32 spaced from the conductive portion 24 of the cavity. Finally, a conductive ball 34 located within the cavity selectively interconnects the electrical contact 32 and the conductive portion 24 of the cavity when the tilt switch 30 is tilted.

In another aspect of the invention, a jitter switch 40 comprises a body 50 including a substantially concave shaped cavity. The substantially concave cavity has a curved bottom surface having a conductive portion (48) thereon and a sidewall having a separate conductive portion (44) thereon. A conductive ball 46 within the cavity intermittently interconnects the conductive portion of the bottom surface 48 with the conductive portion on the sidewall 44 when the jitter switch 40 is in motion.

19 Claims, 6 Drawing Sheets

MOVEMENT SENSOR SWITCH

TECHNICAL FIELD

This invention relates generally to the field of movement sensor switches, and more specifically to tilt and jitter switches.

BACKGROUND

Portable products such as radio transceivers and pagers can include tilt switches to detect whether the portable product is in a non-vertical position or jitter switches to detect slight movements in the portable product. The tilt switches, also known as man down switches, are typically used on portable products such as transceivers by police officers and watchmen and in hazardous conditions such as correctional institutions, prisons, and mines. Presently, mercury switches are used to detect tilt angles on radios and other portable products. Another variety of the tilt switch, the jitter switch, can detect whether the user of a portable product is motionless, indicating that the user may be in danger or dead, but still in a substantially upright position. In a jitter switch, the lack of motion would typically cause the transmission of a coded alert signal that is processed by a computer and displayed for a dispatcher who would be informed as to the identification and approximate position of the motionless user (horizontal user in the case of a tilt switch).

The use of mercury in tilt and jitter switches present several disadvantages. In a market where products continue to get smaller, the use of mercury impedes this trend. Mercury switches are relatively large for use in smaller sized portable electronic communication devices. Mercury switches also limit the angle of the contact closure. This limit in structure of the mercury switches often presents problems in fitting the switches in spaces that are unaccommodating to such structures. Furthermore, the inherent danger of the use of mercury is ever present for the manufacturers and users of such switches. The small number of manufacturers of miniature mercury switches may be an indication of these inherent problems.

SUMMARY OF THE INVENTION

Briefly, according to the invention, a tilt switch comprises a body including a substantially conical cavity. The substantially conical cavity has at least a portion which is electrically conductive. The tilt switch further has an electrical contact spaced from the conductive portion of the cavity. Finally, a conductive ball located within the cavity selectively interconnects the electrical contact and the conductive portion of the cavity when the switch is tilted.

In another aspect of the invention, a jitter switch comprises a body including a substantially concave shaped cavity. The substantially concave cavity has a curved bottom surface having a conductive portion thereon and a sidewall having a separate conductive portion thereon. A conductive ball within the cavity intermittently interconnects the conductive portion of the bottom surface with the conductive portion on the sidewall when the jitter switch is in motion.

DETAILED DESCRIPTION OF THE PREFERRED EMBODIMENT

Figure 1:
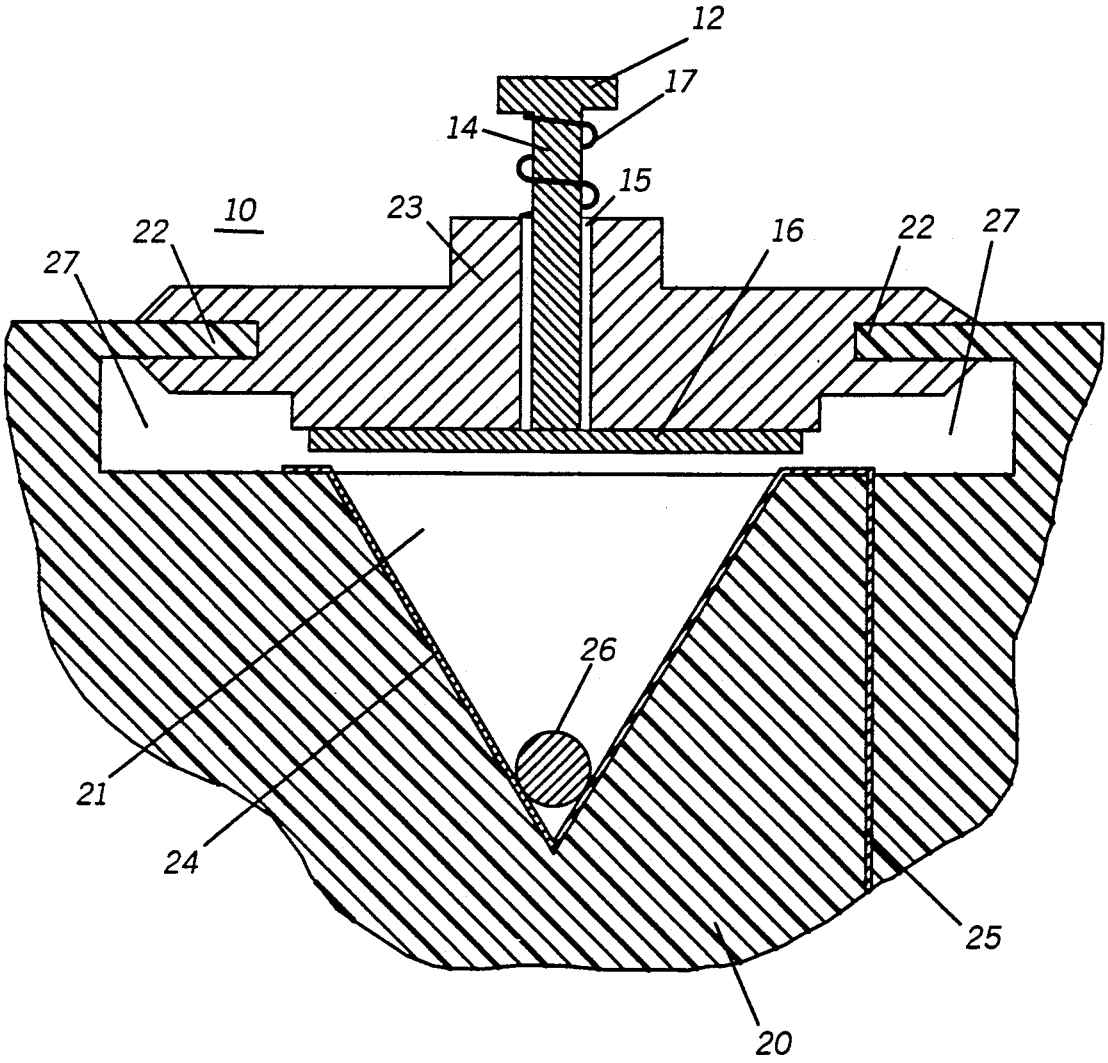
FIG. 1 is a fragmentary cross-sectional view of a tilt switch with a push button in accordance with the present invention.

Referring to FIG. 1, there is shown a tilt switch 10 in accordance with the present invention. The tilt switch 10 has a body 20, preferably made of a nonconductive material such as plastic, which can be an integral part of a housing for a two-way portable radio. The body 20 has a cavity 21 which is preferably substantially conical in shape and has a conductive portion 24. The body 20 further has a lip (22) preferably substantially circular in shape. The conductive portion 24 of the body is preferably metallized with copper and optionally comprised of conductive rubber.

A seal 23 is seated on the lip 22 and preferably encloses the cavity 21 including the conductive portion 24. The seal 23 further encloses another cavity 27 located above the cavity 21. The seal 23, preferably made of rubber (either conductive or nonconductive) has an aperture 15 therein for receiving upper support members 12 and 14 which are selectively slidably connectable to the conductive portion 24 via a contact 16 when the upper support member 12 is depressed. The contact 16 serves a momentary contact function when a upper support member 12 is pressed. A spring means comprising a coil spring, located between the upper support member 12 and the seal 23 biases the switch to its normally open position. When the upper member 12 is depressed, the switch contact 16 momentarily couples with the conductive portion 24 of the cavity, which can generally provide an electrical signal, such as an emergency signal. Alternatively, the switch contact 16 and the conductive portion 24 can be coupled when the tilt switch 10 is tilted to a predetermined angle, typically an angle of 30 degrees from the vertical position. The tilt angle would generally depend on the shape of the substantially conical cavity 21. The tilt switch function is carried out by the use of a conductive ball 26 located within the cavity of the body 20. When the tilt switch is tilted to the predetermined angle (corresponding to the angle of the cavity 21), the conductive ball 26, preferably made of metal and optionally made of conductive rubber, rolls toward the switch contact 16, thereby coupling the switch contact 16 with the conductive portion 24 until the tilt switch 10 is substantially returned to a more vertical position. The switch 10 thereby provides both a tilt switch and a momentary contact switch function.

Figure 2:
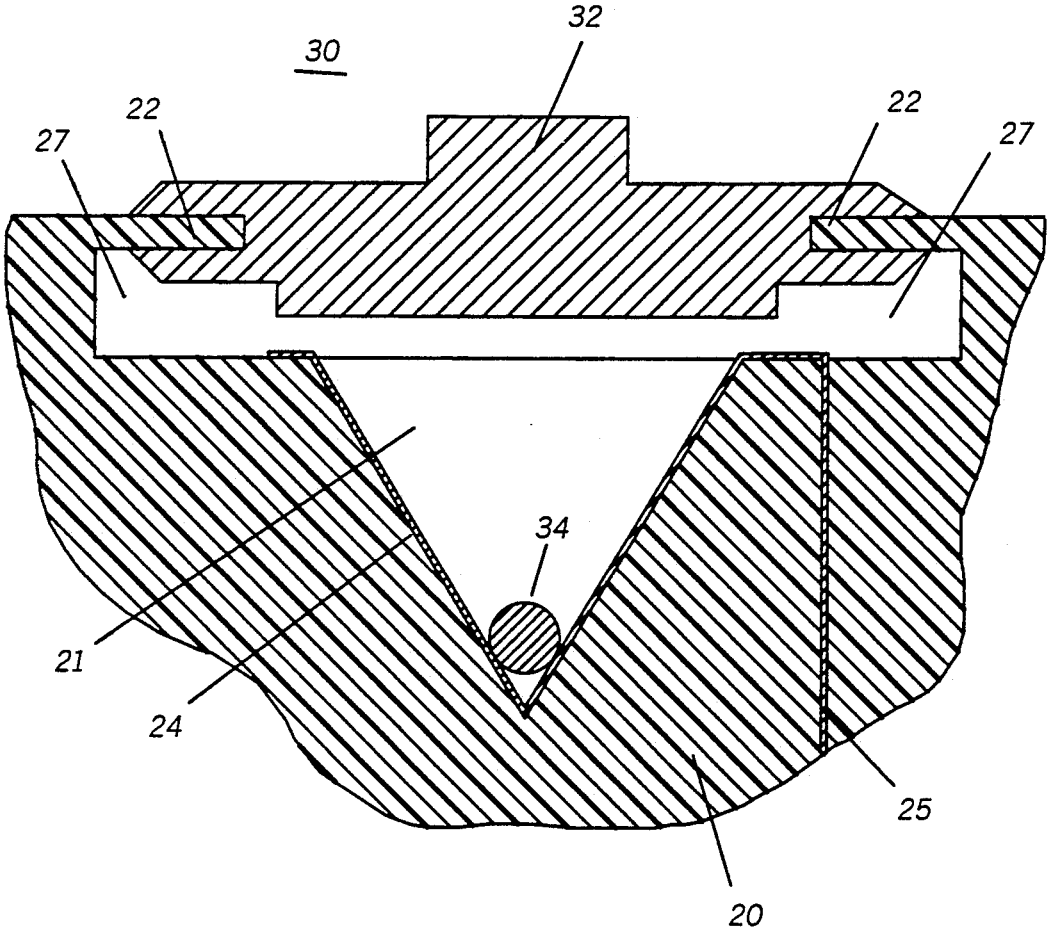
FIG. 2 is a fragmentary cross-sectional view of another tilt switch in accordance with the present invention.
Figure 3:
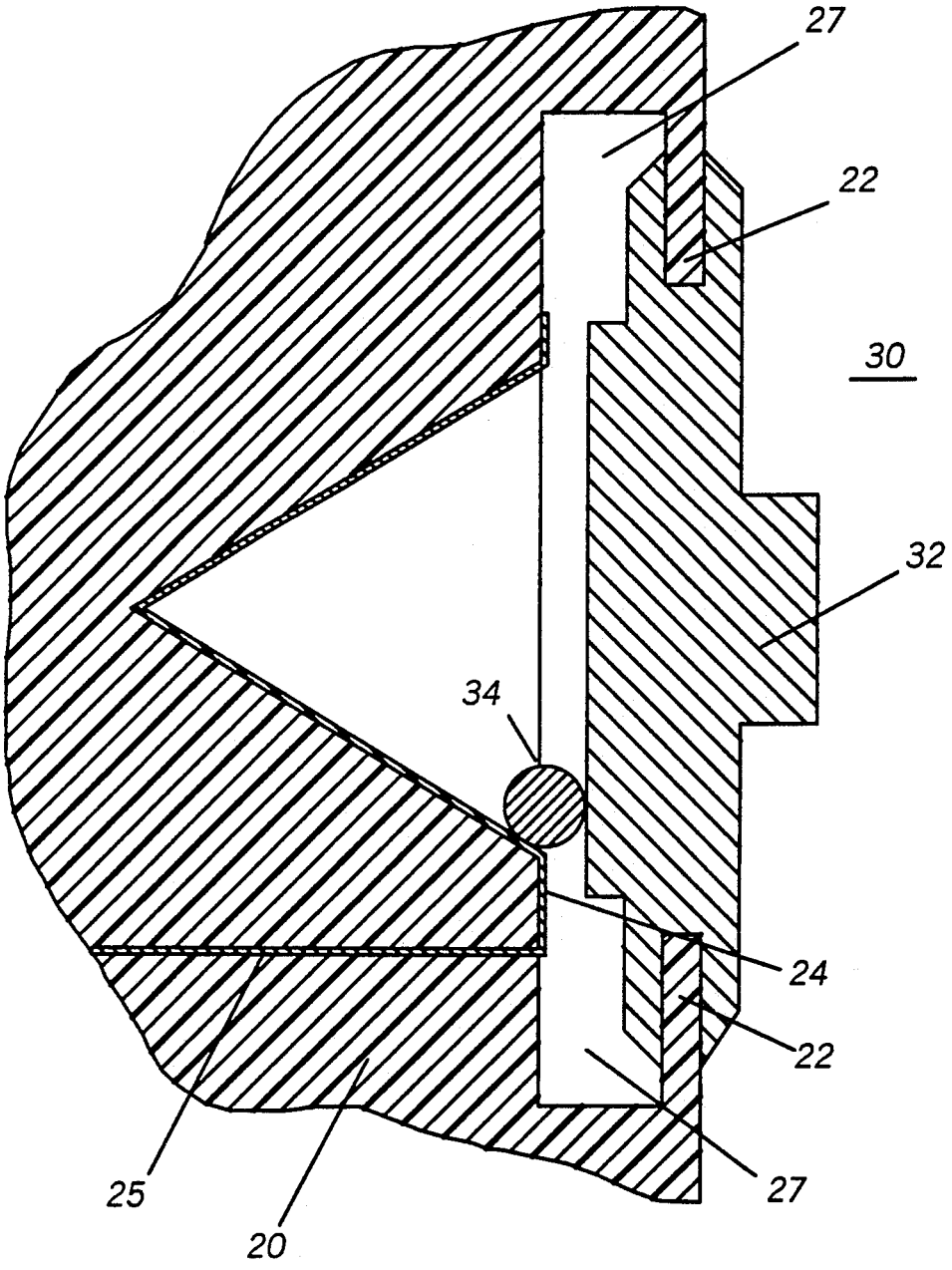
FIG. 3 is a fragmentary cross-sectional view of the tilt switch in FIG. 2 in a tilted (horizontal) position.

Referring to FIG. 2, there is shown another tilt switch 30, similar to tilt switch 10 of FIG. 1. The tilt switch 30 includes a body 20 preferably having a cavity 21 being substantially conical in shape and having a conductive portion 24. The body 20 further has a lip (22) preferably circular in shape for receiving a conductive seal 32. Another cavity 27 is preferably formed between the lip 22 and the cavity 21. The conductive seal 32, preferably forms a hermetic enclosure of the cavities 21 and 27 within the body 20. The conductive seal 32, preferably formed of conductive rubber, serves as a momentary contact switch when the conductive seal 32 is pressed. The conductive seal 32 then momentarily couples the conductive portion 24, thereby causing a signal, generally an emergency signal. Alternatively, the conductive seal 32 and the conductive portion 24 can be coupled when the tilt switch 30 is tilted to a predetermined angle, such as an angle of 30 degrees from vertical. The tilt switch function is accomplished by the use of a conductive ball 34 located within the cavity of the body 20. When the tilt switch is tilted to the predetermined angle, the conductive ball 34, preferably made of metal and optionally made of conductive rubber, rolls toward the conductive seal 32, thereby coupling the conductive seal 32 with the conductive portion 24 until the tilt switch 30 is substantially returned to its original position (vertical). FIG. 3, illustrates the tilt switch of FIG. 2 in a tilted (horizontal) position. The conductive ball 34 is shown coupling the conductive seal 32 with the conductive portion 24 of the cavity. If desired, a dampening fluid such as silicon oil can be retained within the cavity 21 or cavities 21 and 27 of the body 20, slowing the conductive ball 34 from rolling towards the conductive seal 32 once the tilt switch 30 is tilted to the predetermined angle.

Where a momentary contact function is not required, the tilt switch can be constructed without the conductive seal 32 being movable, thereby providing a single function tilt switch.

Referring to FIGS. 1, 2, and 3, conductive traces and through connections (25) can be provided in the housing 20 to provide the necessary electrical connections. In switch 10 or 30, a strap (not shown) can be connected to the switch contact 16 or conductive seal 32, respectively, to provide its electrical connections. Alternatively, in switch 10, a conductive carbon brush (not shown) (similar to ones used in electric motors) or a resilient metal wire (not shown) located within the seal 23 of FIG. 1 can be biased toward contacting the upper support member 14 (if conductive) and can provide the necessary electrical connections.

Figure 4:
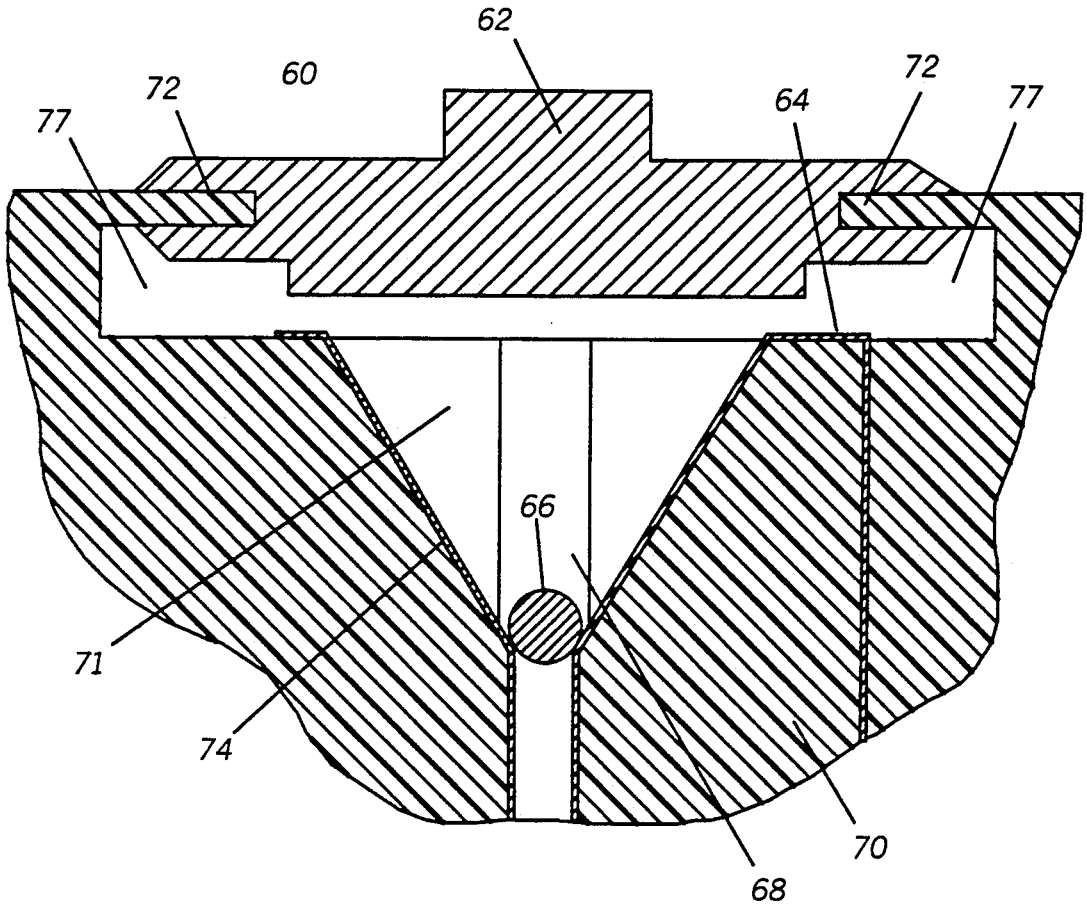
FIG. 4 is a fragmentary cross-sectional view of a normally closed tilt switch in accordance with the present invention.
Figure 5:
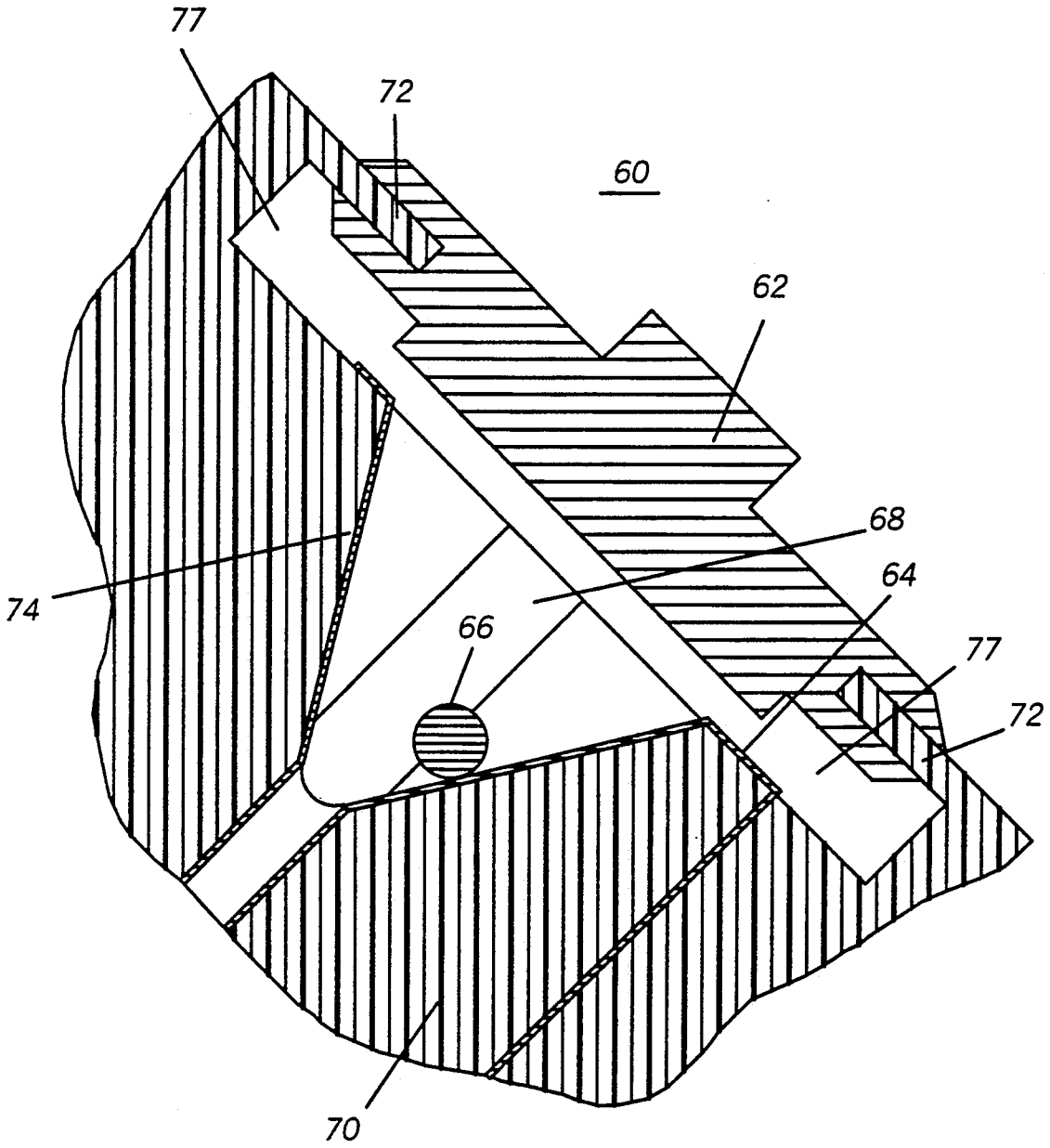
FIG. 5 is a fragmentary cross-sectional view of the normally closed tilt switch in FIG. 4 in a tilted position.

FIGS. 1, 2, and 3 all show a tilt switch that has a normally open circuit. FIGS. 4 and 5 illustrate a similar embodiment of the present invention where the circuit is normally closed. The normally closed and normally open tilt switches use the same concept, but the normally closed switches may provide greater sensitivity and allow for greater range in the use of tilt angles.

Now referring to FIG. 4, there is shown a normally closed tilt switch 60 including a nonconductive body 70, preferably made of plastic, and having a cavity 71 being substantially conical in shape and having at least two conductive portions 64 and 74. The two conductive portions 64 and 74 are preferably metallization on the plastic body 70 separated by a portion of the plastic body 68. The body further has a lip 72 preferably circular in shape for receiving a seal 62. As in previous embodiments, switch 60 includes another cavity 77 located above the cavity 71 that would also be enclosed by the seal 62. When the switch 60 is in the substantially vertical position, a conductive ball 66 normally couples the two conductive portions 64 and 74 together, thereby closing a circuit (not shown).

Referring to FIG. 5, when the switch 60 tilts to a predetermined angle (determined by the shape of the substantially conical cavity), the conductive ball 66 rolls toward the base of the substantially conical cavity, thereby uncoupling the conductive portions 64 and 74 and causing an open circuit. The momentary contact function used in switch 30 of FIG. 2 can be used in switch 60 with additional wiring as described for FIG. 2 and where the seal 62 is made from movable conductive material. Otherwise, the tilt switch can be constructed without the seal 62 being movable (or conductive), thereby providing a single function tilt switch.

Figure 6:
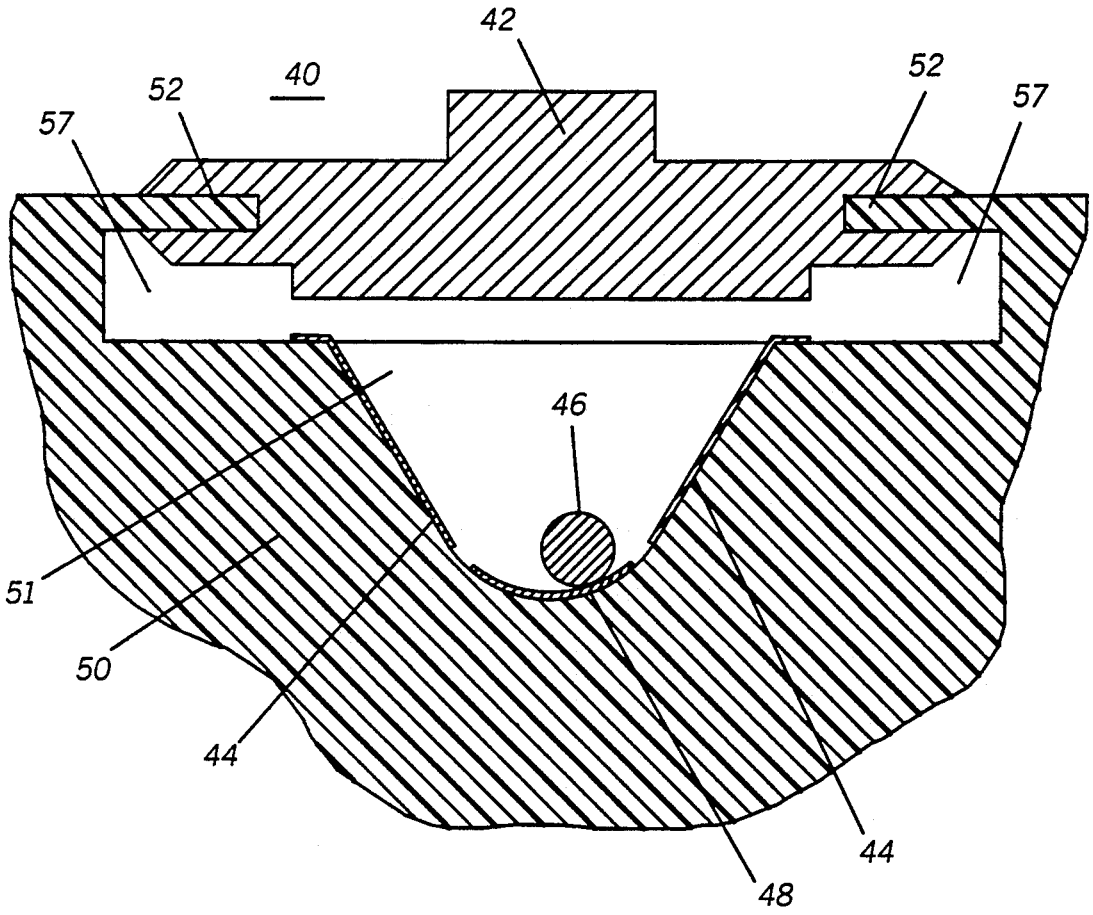
FIG. 6 is a fragmentary cross-sectional view of a jitter switch in accordance with the present invention.

Referring to FIG. 6, there is shown a jitter switch 40 having a body 50, preferably made of a nonconductive material such as plastic, which can be an integral part of a housing for a two-way portable radio similar to switch 10. The body 50 has a cavity 51 which preferably has a substantially truncated conical shape or a cupped shape having a curved bottom surface (48) and a sidewall (44). The curved bottom surface and the sidewall each have separate conductive surfaces 48 and 44 respectively that are preferably metallized. The body 50 further has a lip (52) preferably substantially circular in shape for receiving a seal 42 that is either conductive or nonconductive. The seal 42 further encloses another cavity 57 located between the seal 42 and the cavity 51.

The seal 42 is seated on the lip 52 and preferably encloses the cupped shaped cavity including conductive portions 44 and 48. The seal 42, if movable, can serve as a momentary contact switch as described in switch 30 in FIGS. 2 and 3.

The jitter switch function is accomplished by the use of a conductive ball 46 located within the cupped shape cavity of the body 50. When the jitter switch 40 is in motion, the conductive ball 46 makes and breaks contact with the metallized surfaces 48 and 44. The sensitivity of the jitter switch 40 in detecting motion is dependent on the curvature of the (metallized) curved bottom surface 46 and the slope of the metallized sidewall 44. Optionally, greater sensitivity can also be obtained by having more separate metallized surfaces within the cavity, which may require more wiring. The jitter switch 40 can be incorporated into a two-way radio that would be programmed to send a distress signal to a dispatcher when the radio unit detects a lack of switching in the jitter switch 40 for a time exceeding the maximum time anticipated. As in the tilt switches previously described, a dampening fluid such as silicon oil can be retained in the cavity (if desired) to dampen the motion of the conductive ball, thereby reducing the motion sensitivity of the jitter switch.

What is claimed is:

1. A tilt switch comprising:

a non-conductive body including a substantially conical cavity, at least a portion of the cavity being electrically conductive;

an electrical contact arranged and constructed to form a seal above the cavity and spaced from the conductive portion of the cavity, said electrical contact being selectively movable into contact with the electrically conductive portion of the cavity for providing a momentary contact function;

a conductive ball within the cavity for selectively interconnecting the contact and the conductive portion of the cavity when the switch is tilted.

2. A tilt switch as defined in claim 1, wherein the cavity contains a dampening fluid such as silicon oil for delaying the activation of the tilt switch.

3. A tilt switch as defined in claim 1, wherein the conductive ball, the conductive cavity portion, and the electrical contact comprise conductive rubber.

4. A tilt switch as defined in claim 1, wherein the conductive ball, the conductive cavity portion, and the electrical contact comprise conductive metal.

5. A tilt switch as defined in claim 1, wherein the conductive ball and the electrical contact comprise conductive rubber and the conductive cavity portion comprises conductive metal.

6. A tilt switch, comprising:

a non-conductive body including a lip above a substantially conical cavity, at least a portion of the cavity being electrically conductive;

a conductive seal engaged upon said lip for providing a hermetic seal for said cavity, said conductive seal being selectively movable into contact with the conductive cavity portion for providing a momentary contact function: and a conductive ball for electrically coupling the conductive cavity and the conductive seal when the tilt switch is tilted to a predetermined angle.

7. The tilt switch of claim 6, wherein the non-conductive body comprises a nonconductive material such as plastic and the conductive cavity portion comprises a conductive metal such as copper.

8. The tilt switch of claim 6, wherein the non-conductive body comprises a nonconductive material such as plastic and the conductive cavity comprises a conductive material such as conductive rubber.

9. The tilt switch of claim 7, wherein the conductive ball is comprised of a conductive metal sphere.

10. The tilt switch of claim 7, wherein the conductive ball is comprised of a conductive rubber sphere.

11. The tilt switch of claim 6, wherein the sealed enclosure contains a dampening fluid such as silicon oil for delaying the activation of the tilt switch.

12. The tilt switch of claim 6, wherein the conductive seal is constructed and arranged to resiliently connect to the conductive cavity portion when said conductive seal is pressed.

13. A tilt switch, comprising:

a non-conductive body including a lip for engaging a seal having an aperture therein, and further including a substantially conical cavity, at least a portion of the cavity being electrically conductive;

a conductive contact having an upper support member for vertically slidably connecting to the conductive cavity portion via the aperture in the seal for providing a momentary contact function; and a conductive ball for coupling the conductive cavity portion and the conductive contact when said tilt switch is tilted to a prescribed angle.

14. The tilt switch of claim 13, wherein the seal for engaging the lip of the body comprises of a nonconductive material.

15. The tilt switch of claim 13, wherein the conductive contact includes spring means arranged and constructed to form about the upper support member for providing a momentary contact switch function.

16. A combination jitter and tilt switch comprising:

a non-conductive body including a substantially concave shaped cavity having a curved bottom surface and a sidewall;

a conductive portion on the curved bottom surface;

a separate conductive portion on the sidewall;

an electrical contact arranged and constructed to form a seal above the cavity and spaced from the conductive portions of the cavity to form a sealed cavity with the body non-conductive body said electrical contact being selectively movable into contact with one of the electrically conductive portions of the cavity for providing a momentary contact function: and a conductive ball confined within the cavity by said electrical contact for intermittently interconnecting the conductive portion of the bottom surface with the conductive portion on the sidewall when the jitter switch is in a predetermined range of motion and alternately for interconnecting the conductive portions on the sidewall with the electrical contact when said jitter switch is tilted at a predetermined angle.

17. A combination jitter and tilt switch comprising:

a non-conductive body including a substantially concave shaped cavity having a curved bottom surface and a sidewall;

a conductive portion on the curved bottom surface and separate conductive portion on the sidewall;

an electrical contact spaced from the conductive portions of the cavity and arranged and constructed to form a sealed cavity with the non-conductive body;

a conductive ball confined within the cavity for intermittently interconnecting the conductive portion of the bottom surface with the conductive portion of the sidewall when the jitter switch is in motion in a substantially vertical orientation and for selectively interconnecting the contact and the conductive portion of the sidewall when the switch is tilted to a predetermined angle in a substantially horizontal orientation.

18. A tilt switch comprising:

a body including a substantially conical cavity, at least having two electrically conductive portions on the surface of the conical cavity;

an electrical contact spaced from one of the conductive portions of the cavity which is selectively movable into contact with the electrically conductive portion of the cavity for providing a momentary contact switch function;

a conductive ball confined within the cavity for connecting the conductive portions when the tilt switch is substantially vertical and for disconnecting the conductive portions when the tilt switch tilts more than a predetermined angle.

19. The tilt switch of claim 18, wherein the conductive ball further couples the electrical contact with one of the conductive portions when the switch is substantially horizontal.

* * * * *